US010453478B2

(12) United States Patent
Nariyama

(10) Patent No.: US 10,453,478 B2
(45) Date of Patent: Oct. 22, 2019

(54) SOUND QUALITY DETERMINATION DEVICE, METHOD FOR THE SOUND QUALITY DETERMINATION AND RECORDING MEDIUM

(71) Applicant: YAMAHA CORPORATION, Hamamatsu-shi (JP)

(72) Inventor: Ryuichi Nariyama, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/920,532

(22) Filed: Mar. 14, 2018

(65) Prior Publication Data

US 2018/0204588 A1 Jul. 19, 2018

Related U.S. Application Data

(63) Continuation of application No. PCT/JP2016/076180, filed on Sep. 6, 2016.

(30) Foreign Application Priority Data

Sep. 17, 2015 (JP) ..... 2015-183718

(51) Int. Cl.
*G10L 25/60* (2013.01)
*G10H 1/06* (2006.01)
(Continued)

(52) U.S. Cl.
CPC ..... *G10L 25/60* (2013.01); *G10H 1/00* (2013.01); *G10H 1/06* (2013.01);
(Continued)

(58) Field of Classification Search
None
See application file for complete search history.

(56) References Cited

U.S. PATENT DOCUMENTS

2003/0055646 A1* 3/2003 Yoshioka ..... G10L 13/033 704/258
2006/0089836 A1* 4/2006 Boillot ..... G10L 19/26 704/500

(Continued)

FOREIGN PATENT DOCUMENTS

JP 2012194389 A 10/2012
JP 2014130227 A 7/2014

OTHER PUBLICATIONS

English translation of Written Opinion issued in Intl. Appln. No. PCT/JP2016/076180 dated Nov. 22, 2016, previously filed Mar. 14, 2018.

(Continued)

*Primary Examiner* — Qin Zhu
(74) *Attorney, Agent, or Firm* — Rossi, Kimms & McDowell LLP

(57) ABSTRACT

A sound quality determination device includes an acquisition unit acquiring an input sound, a frequency distribution calculation unit calculating a frequency distribution of the input sound acquired by the acquisition unit, a tilt calculation unit calculating a tilt indicating a change in intensity of an overtone with respect to a frequency based on the frequency distribution calculated by the frequency distribution calculation unit, a tilt comparison unit comparing the tilt calculated by the tilt calculation unit and a threshold related to the tilt, and a determination unit determining based on a result of comparison by the tilt comparison unit whether the input sound has a predetermined sound quality.

20 Claims, 13 Drawing Sheets

(51) Int. Cl.
*G10H 1/00* (2006.01)
*G10L 25/18* (2013.01)
*G10L 25/51* (2013.01)

(52) U.S. Cl.
CPC . *G10H 2210/066* (2013.01); *G10H 2210/091* (2013.01); *G10L 25/18* (2013.01); *G10L 25/51* (2013.01)

(56) References Cited

U.S. PATENT DOCUMENTS

2011/0013783 A1* 1/2011 Sugawara ..... G10H 1/0091 381/98
2011/0099018 A1* 4/2011 Neuendorf ..... G10L 21/038 704/500
2011/0178795 A1* 7/2011 Bayer ..... G10L 19/002 704/205
2011/0178805 A1* 7/2011 Takeuchi ..... G10L 25/60 704/278
2013/0041658 A1* 2/2013 Bradley ..... H04R 29/00 704/208
2013/0182862 A1* 7/2013 Disch ..... G10H 1/08 381/61
2015/0348562 A1* 12/2015 Krishnaswamy ... G10L 21/0264 704/206

OTHER PUBLICATIONS

International Search Report issued in Intl. Appln. No. PCT/JP2016/076180 dated Nov. 22, 2016. English translation provided.
Written Opinion issued in Intl. Appln. No. PCT/JP2016/076180 dated Nov. 22, 2016.
Office Action issued in Japanese Appln. No. 2015-183718 dated Sep. 10, 2019. English translation provided.

* cited by examiner

SOUND QUALITY DETERMINATION DEVICE, METHOD FOR THE SOUND QUALITY DETERMINATION AND RECORDING MEDIUM

CROSS REFERENCE TO RELATED APPLICATIONS

This application is based upon and claims the benefit of priority from the prior Japanese Patent Application No. 2015-183718 filed on Sep. 17, 2015, and PCT Application No. PCT/JP2016/076180 filed on Sep. 6, 2016, the entire contents of which are incorporated herein by reference.

FIELD

The present invention relates to techniques for determining sound quality on a real-time basis.

BACKGROUND

There is a vocal technique called falsetto. This is a technique for creating sound emission corresponding to a particularly high pitch (sound pitch) and is also generally used among artists. Thus, in recent years, there is a move afoot to develop technology of objectively evaluating vocals including a natural voice and falsetto (Japanese Unexamined Patent Application Publication No. 2014-130227).

SUMMARY

A sound quality determination device according to one embodiment of the present invention includes an acquisition unit acquiring an input sound, a frequency distribution calculation unit calculating a frequency distribution of the input sound acquired by the acquisition unit, a tilt calculation unit calculating a tilt indicating a change in intensity of an overtone with respect to a frequency based on the frequency distribution calculated by the frequency distribution calculation unit, a tilt comparison unit comparing the tilt calculated by the tilt calculation unit and a threshold related to the tilt, and a determination unit determining based on a result of comparison by the tilt comparison unit whether the input sound has a predetermined sound quality.

The sound quality determination device may further include an overtone ratio calculation unit calculating an overtone ratio indicating a ratio of a frequency of an overtone with respect to a frequency of a fundamental tone based on the frequency distribution calculated by the frequency distribution calculation unit, and an overtone ratio comparison unit comparing the overtone ratio calculated by the overtone ratio calculation unit and a threshold related to the overtone ratio, wherein the determination unit may determine whether the input sound has the predetermined sound quality based on the result of comparison by the tilt comparison unit and a result of comparison by the overtone ratio comparison unit.

Also, a sound quality determination device of another embodiment of the present invention includes an acquisition unit which acquire an input sound, a frequency distribution calculation unit which calculates a frequency distribution of the input sound acquired by the input sound acquisition unit, an overtone ratio calculation unit which calculates an overtone ratio indicating a ratio of overtone with respect to a fundamental tone based on the frequency distribution calculated by the frequency distribution calculation unit, an overtone ratio comparison unit which compares the overtone ratio calculated by the overtone ratio calculation unit and a threshold related to the overtone ratio, and a determination unit which determines based on a result of comparison by the overtone ratio comparison unit whether the input sound has a predetermined sound quality.

As the threshold related to the tilt or the threshold related to the overtone ratio, a value derived by using a frequency of a fundamental tone in the frequency distribution may be used. These thresholds may be derived from a predetermined arithmetic expression or derived from a lookup table with tilts or overtone ratios and thresholds associated with each other in advance. When the threshold is derived from the predetermined arithmetic expression, the device may further include a parameter changing unit capable of changing a parameter of the arithmetic expression.

Also, the device may further include a selection unit selecting an accompaniment sound to be outputted during an input period of the input sound, and the parameter changing unit may change the parameter based on information associated with the selected accompaniment sound.

In the above-described sound quality determination device, the determination unit may determine that the sound has the predetermined sound quality when the tilt satisfies a predetermined criterion or may determine that the sound has the predetermined sound quality when the tilt continuously satisfies a predetermined criterion for a predetermined time.

Also, a computer-readable recording medium according to one embodiment of the present invention has recorded thereon a program for causing a computer to perform acquiring an input sound, calculating a frequency distribution of the acquired input sound, calculating a tilt indicating a change in intensity of overtone with respect to frequency based on the calculated frequency distribution, comparing the calculated tilt and a threshold related to the tilt, and determining based on a result of comparison whether the input sound has a predetermined sound quality.

Also, a computer-readable recording medium according to another embodiment of the present invention has recorded thereon a program for causing a computer to perform acquiring an input sound, calculating a frequency distribution of the acquired input sound, calculating an overtone ratio indicating a ratio of overtone with respect to a fundamental tone based on the calculated frequency distribution, comparing the calculated overtone ratio and a threshold related to the overtone ratio, and determining based on a result of comparison whether the input sound has a predetermined sound quality.

Also, a method according to one embodiment of the present invention includes acquiring an input sound, calculating a frequency distribution of the acquired input sound, calculating a tilt indicating a change in intensity of overtone with respect to frequency based on the calculated frequency distribution, comparing the calculated tilt and a threshold related to the tilt, and determining based on a result of comparison whether the input sound has a predetermined sound quality.

Also, a method according to one embodiment of the present invention includes acquiring an input sound, calculating a frequency distribution of the acquired input sound, calculating an overtone ratio indicating a ratio of overtone with respect to a fundamental tone based on the calculated frequency distribution, comparing the calculated overtone ratio and a threshold related to the overtone ratio, and determining based on a result of comparison whether the input sound has a predetermined sound quality.

According to the above-described structure, sound quality can be determined on a real-time basis without requiring an enormous amount of data.

DESCRIPTION OF EMBODIMENTS

In the technology described in Japanese Unexamined Patent Application Publication No. 2014-130227, mechanical learning is required to be performed at an evaluation unit, posing a problem of requiring an enormous amount of data.

An object of the present invention is to determine sound quality on a real-time basis without requiring an enormous amount of data.

In the following, a quality determination device in one embodiment of the present invention is described in detail with reference to the drawings. Embodiments described below are merely examples of embodiments of the present invention, and the present invention is not limited to these embodiments.

(First Embodiment)

A sound quality determination device 10 in a first embodiment of the present invention is described. The sound quality determination device 10 in the first embodiment is a device with a function of determining sound quality of singing voice of a singing user (who may be hereinafter referred to as a singer). The sound quality determination device 10 has a function of evaluating a sound quality parameter by using a threshold depending on a change in pitch (basic frequency) and determining that the sound has a specific sound quality when a predetermined condition is satisfied.

In the present embodiment, an example is described in which a tilt (its details will be described further below) indicating a change in intensity of overtone with respect to frequency is used as a sound quality parameter and falsetto is determined from the singing voice as a sound quality.

[Hardware]

Figure 1:
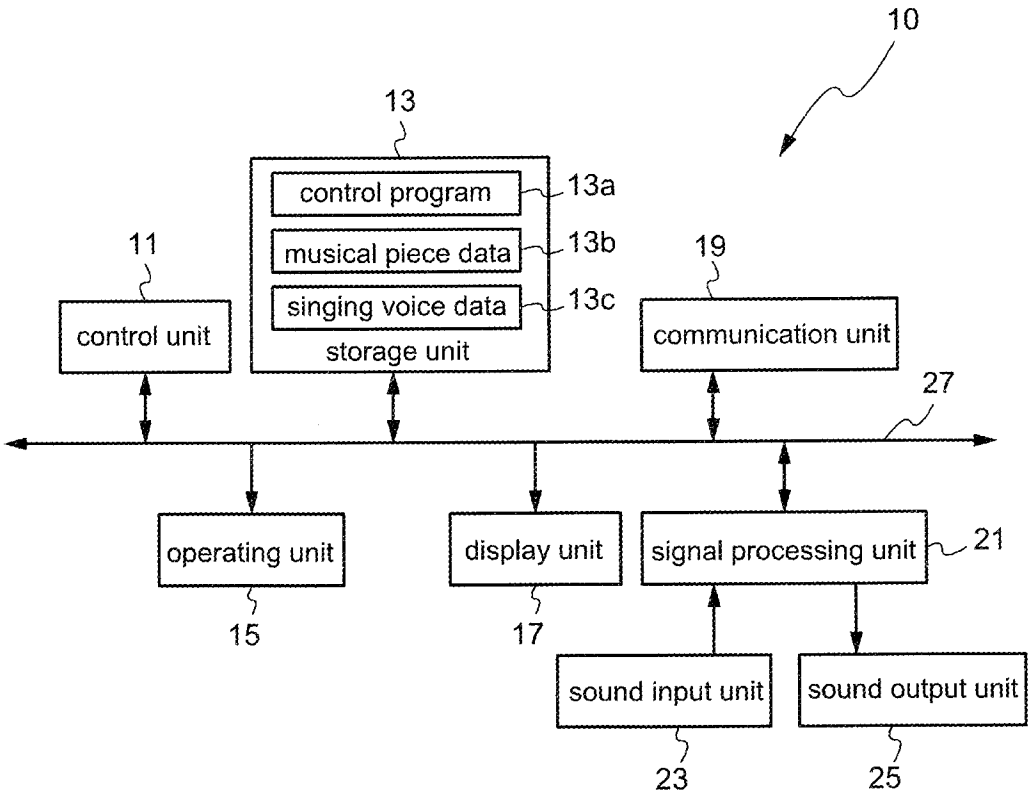
FIG. 1 is a block diagram depicting the structure of a sound quality determination device in a first embodiment of the present invention.

FIG. 1 is a block diagram depicting the structure of the sound quality determination device 10 in the first embodiment of the present invention. The sound quality determination device 10 is, for example, a karaoke device with a singing grading function. The sound quality determination device 10 includes a control unit 11, a storage unit 13, an operating unit 15, a display unit 17, a communication unit 19, and a signal processing unit 21. Also, to the signal processing unit 21, a sound input unit (for example, microphone) 23 and a sound output unit (for example, loudspeaker) 25 are connected. Each of these components are mutually connected via a bus 27.

The control unit 11 includes an arithmetic operation processing circuit such as a CPU (Central Processing Unit). The control unit 11 causes the CPU to execute a control program 13*a* stored in the storage unit 13 to achieve various functions in the sound quality determination device 10. The functions to be achieved include a sound quality determination function of singing voice. As a specific example of the sound quality determination function, a function of determining falsetto from singing voice is illustrated in the present embodiment.

The storage unit 13 is a storage device such as a non-volatile memory or hard disk. The storage unit 13 stores the control program 13*a* for achieving the sound quality determination function. The control program 13*a* may be provided in a state of being stored in a computer-readable recording medium such as a magnetic recording medium, optical recording medium, magneto-optical recording medium, or semiconductor memory. In this case, it is only required that the sound quality determination device 10 includes a device which reads the recording medium. Also, the control program 13*a* may be downloaded to the storage unit 13 via a network such as the Internet.

Also, the storage unit 13 stores musical piece data 13*b* and singing voice data 13*c* as data regarding singing. The musical piece data 13*b* includes data related to a song for karaoke, for example, guide melody data, accompaniment data, lyrics data, and so forth. The guide melody data is data indicating a melody of the song. The accompaniment data is data indicating accompaniment of the song. The guide melody data and the accompaniment data may be data represented in MIDI (Musical Instrument Digital Interface) format. The lyrics data is data for displaying the lyrics of the song and data indicating a timing when the color of a telop of the lyrics displayed. The singing voice data 13*c* is data indicating a singing voice inputted by a singer from the sound input unit 23. In this example, the singing voice data is stored in the storage unit 13 until a sound quality determination is made based on a singing voice by the sound quality determination function.

The operating unit 15 is a device provided to an operation panel, a remote controller, or the like, such as an operation button, a keyboard, or a mouse, outputting a signal in accordance with inputted operation to the control unit 11. The display unit 17 is a display device such as a liquid-crystal display or an organic EL display, where a screen is displayed based on the control by the control unit 11. Note that the operating unit 15 and the display unit 17 may integrally configure a touch panel. The communication unit 19 is connected to a communication line such as the Internet or a LAN (Local Area Network) to transmit or receive information to or from an external device such as a server based on the control by the control unit 11. Note that the function of the storage unit 13 may be achieved by an external device communicable at the communication unit 19.

The signal processing unit 21 includes a sound source which generates an audio signal from a signal in MIDI format, an A/D converter, a D/A converter, and so forth. A singing voice is converted at the sound input unit 23 such as a microphone into an electrical signal and inputted to the signal processing unit 21 and is subjected to A/D conversion at the signal processing unit 21 and outputted to the control unit 11. As described above, the singing voice is stored in the storage unit 13 as singing voice data. Also, the accompaniment data is read by the control unit 11 from the storage unit 13, is subjected to D/A conversion at the signal processing unit 21 and is outputted from the sound output unit 25 such as a loudspeaker as an accompaniment sound. Here, a guide melody may also be outputted from the sound output unit 25.

[Sound Quality Determination Function]

The sound quality determination function to be achieved by the control unit 11 of the sound quality determination device 10 executing the control program 13*a* stored in the storage unit 13 is described. Note that the structure to achieve the sound quality determination function described below may be partially or entirely achieved by hardware.

Figure 2:
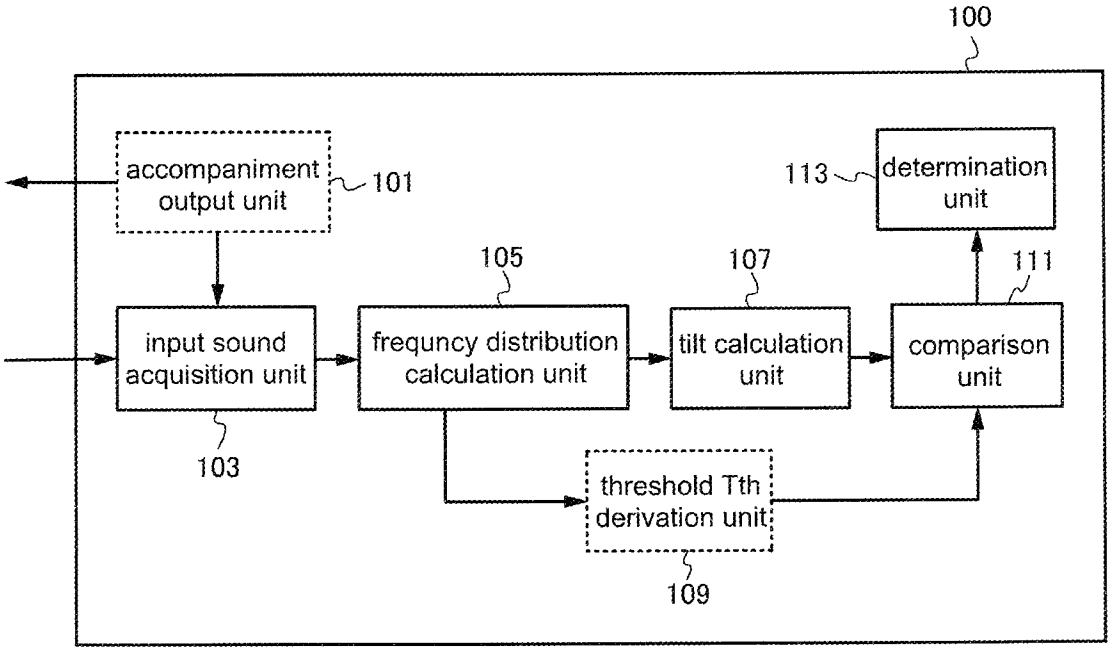
FIG. 2 is a block diagram depicting the structure of a sound quality determination function in the first embodiment of the present invention.

FIG. 2 is a block diagram depicting the structure of a sound quality determination function 100 in the first embodiment of the present invention. The sound quality determination function 100 includes an accompaniment output unit 101, an input sound acquisition unit 103, a frequency distribution calculation unit 105, a tilt calculation unit 107, a threshold Tth derivation unit 109, a comparison unit 111, and a determination unit 113. Note that the accompaniment output unit 101 and the threshold Tth derivation unit 109 are not indispensable structures as structures of the sound quality determination function, and thus are indicated by broken lines. The same goes for FIG. 5, FIG. 9, and FIG. 11 to FIG. 13, and components (functions) indicated by broken lines are not indispensable structures.

The accompaniment output unit 101 reads accompaniment data corresponding to a song specified by a singer from the storage unit 13, inputs the read data via the signal processing unit 21 to the sound output unit 25 for output as an accompaniment sound. The input sound acquisition unit 103 acquires singing voice data indicating a singing voice inputted from the sound input unit 23. In this example, an input sound to the sound input unit 23 in a period in which the accompaniment sound is outputted is recognized as a singing voice of a determination target. Note that the input sound acquisition unit 103 may directly acquire the singing voice data from the signal processing unit 21 or may acquire the singing voice data once stored in the storage unit 13. Also, the input sound acquisition unit 103 is not limited to acquire the singing voice data indicating an input sound to the sound input unit 23 but may acquire by the communication unit 19 the singing voice data indicating an inputs sound to an external device via a network.

The frequency distribution calculation unit 105 performs a Fourier analysis on the singing voice data acquired by the input sound acquisition unit 103 for each frame (each of data samples sectioned by predetermined periods) to calculate a frequency distribution in each frame. From the frequency distribution acquired at the frequency distribution calculation unit 105, a relation between a fundamental tone and an overtone of the singing voice in each frame can be found.

Figure 3:
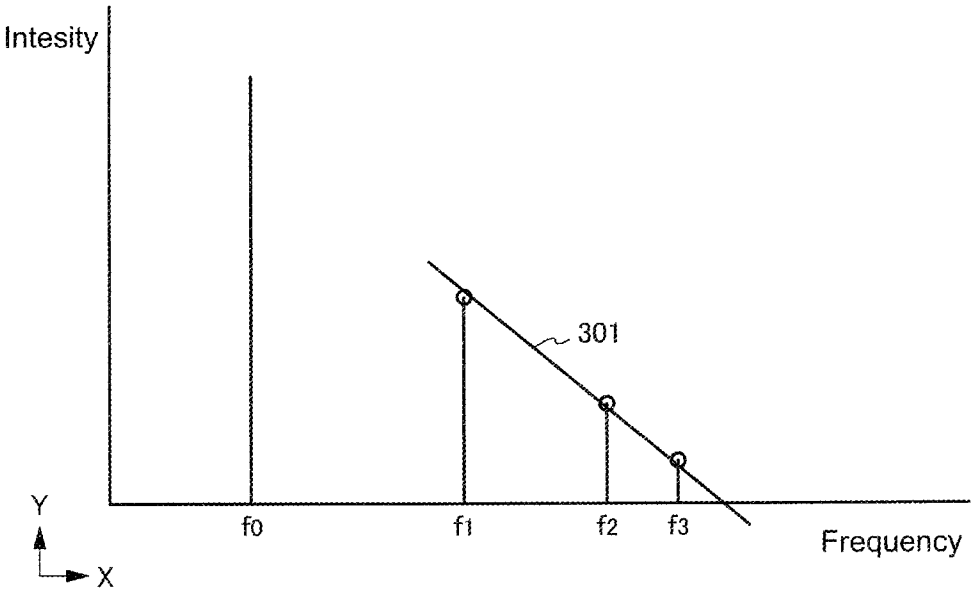
FIG. 3 is a diagram for describing a concept of a tilt.

The tilt calculation unit 107 calculates a tilt (T) from the frequency distribution of the singing voice data acquired at the frequency distribution calculation unit 105. Here, the tilt is a value indicating a change in intensity (power) of overtone with respect to the frequency. For example, the tilt calculation unit 107 obtains a plurality of intensities corresponding to a plurality of overtones from the frequency distribution and calculates a gradient of a linear function acquired by linear approximation using the plurality of these intensities as a tilt. FIG. 3 is a diagram for describing a concept of a tilt. In FIG. 3, the horizontal axis represents frequency components included in singing voices on a logarithmic scale, and the vertical axis represents sound intensities for each frequency on a logarithmic scale. A frequency f0 is called a pitch (fundamental frequency), corresponding to the frequency of the fundamental tone. Also, frequencies f1, f2, and f3 correspond to frequencies of a second harmonic, a third harmonic, and a fourth harmonic, respectively.

Here, for example, a linear function 301 can be acquired by linear approximation by a least squares method is performed on a peak value of intensity of each overtone. In general, overtones (higher-order harmonics) of higher frequencies have smaller intensities, and therefore the linear function 301 often drops to the right. Thus, when the linear function 301 is represented by an expression, normally $y=-ax+b$ ("x" and "y" are variables corresponding to the x axis and the y axis of FIG. 3, respectively), and a constant "a" at this time is defined as a "tilt" in the specification. That is, the "tilt" can be said as a parameter indicating how the intensity of the overtone decreases with respect to an increase of the frequency.

Note that while the tilt is found by linear approximation by the least squares method in this example, any scheme that can extract a parameter indicating how the intensity of the overtone changes with respect to the change of the frequency may be used to find the tilt. Also, while the example has been described in which the intensity peak value of overtone is used as one example of "intensity corresponding to overtone", it is not required to limit this to the peak value, and it is only required to use a value that can represent a tendency of a change in intensity of each overtone. For example, a value of intensity in the frequency of overtone (which may be different from the above-described peak value) may be used, or an area acquired by integrating the intensity of overtone by a predetermined range may be used.

Also, while the tilt is found by using f1 to f3 (that is, the second harmonic to the fourth harmonic) in the example of FIG. 3, this is not meant to be restrictive, and any overtones for use in tilt calculation can be determined. Furthermore, for example, the tilt can be calculated by using overtones with a predetermined intensity or more.

The threshold Tth derivation unit 109 derives a threshold based on the pitch acquired by the frequency distribution calculation unit 105 as the tilt-related threshold (Tth). The tilt-related threshold (Tth) is a value that changes depending on the pitch and can be derived by using a predetermined arithmetic expression (for example, a function Ft(F0) with pitch taken as an independent variable). Here, the predetermined arithmetic expression may be a linear function or a higher-order function of a second order or higher. Furthermore, in place of the scheme of using a predetermined arithmetic expression, the threshold may be derived from a lookup table with pitches and thresholds associated with each other in advance. It is only required that these arithmetic expression and lookup table are found in advance by, for example, performing statistical processing on various singing voices.

The comparison unit 111 compares the tilt acquired at the tilt calculation unit 107 and the tilt-related threshold acquired by the threshold Tth derivation unit 109, and then outputs a signal indicating a relation in magnitude between the tilt and the threshold to the determination unit 113.

The determination unit 113 determines based on the signal indicating the relation in magnitude between the tilt and the threshold acquired from the comparison unit 111 whether the singing voice data acquired at the input sound acquisition unit 103 indicates falsetto. Here, the above-described tilt-related threshold has a meaning as a value serving as an index for determining whether the singing voice is falsetto at any pitch. Specifically, when a tilt in a certain frame is equal to or larger than a predetermined threshold depending on the pitch in that frame (that is, when a constant "a" indicating the tilt of the linear function 301 described above is equal to or larger than the predetermined threshold), the singing voice in that frame is determined as falsetto.

Figure 4:
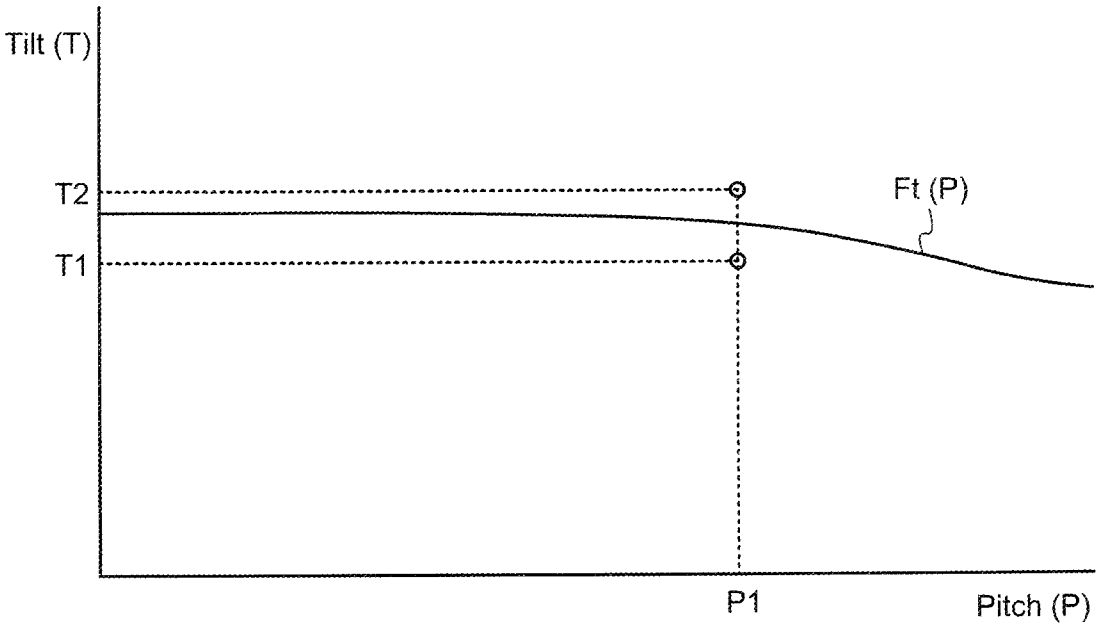
FIG. 4 is a diagram for describing a concept of falsetto determination by a determination unit configuring the sound quality determination function in the first embodiment of the present invention.

FIG. 4 is a diagram for describing a concept of falsetto determination in the determination unit 113. In FIG. 4, the horizontal axis represents pitch (P) and the vertical axis represents tilt (T). In FIG. 4, a function Ft(P) is depicted as a predetermined arithmetic expression for deriving the above-described threshold (Tth). In this example, when a pitch (P) in a certain frame is determined, the threshold (Tth) corresponding to that pitch is found from the function Ft(P). At the determination unit 113, based on the result of comparison between the tilt calculated at the tilt calculation unit 107 and the threshold (Tth) found at the threshold Tth derivation unit 109 from the function Ft(P), it is determined that the singing voice in that frame is falsetto when the tilt is equal to or larger than the threshold (Tth).

In FIG. 4, in a certain frame 1, it is assumed that the pitch is P1, the tilt is T1, and T1 is smaller than the threshold (Ft(P1)). In this case, the determination unit 113 determines that the singing voice in the frame 1 is a natural voice. On the other hand, in a frame 2 different from the frame 1, it is assumed that the pitch is P1, the tilt is T2, and T2 is equal to or larger than the threshold (Ft(P2)). In this case, the determination unit 113 determines that the singing voice in the frame 2 is falsetto. Note that while the example has been described in which whether the singing voice is falsetto is determined per frame unit herein, a configuration may be adopted in which the singing voice is determined as falsetto when the above-described condition is satisfied successively for a predetermined number of frame or more.

According to the findings by the inventors, the intensity tends to abruptly decrease as the sound quality (voice quality) of the singing voice is closer to falsetto, that is, as it is becoming closer to a higher-order harmonic like second harmonic, third harmonic, and fourth harmonic in a frequency distribution diagram as depicted in FIG. 3. That is, as depicted in FIG. 3, the tilt (gradient) indicating a change in intensity of overtone with respect to frequency becomes steep. With the use of this tendency, if a tilt can be calculated and becomes equal to or larger than a predetermined threshold (that is, if a change in intensity of overtone with respect to frequency is steep), the voice can be determined as falsetto. While the above-described function Ft(P) can change depending on the vocalist, the function Ft(P) can be found in advance by statistically processing singing voices of various persons.

As described above, in the sound quality determination device 10 in the first embodiment, the frequency distribution calculation unit 105 performs a frequency analysis on the singing voice data inputted from the input sound acquisition unit 103 and, based on that analysis result, the tilt calculation unit 107 calculates a tilt as a sound quality parameter. Then, the comparison unit 111 compares the calculated tilt and the predetermined tilt-related threshold acquired from the threshold Tth derivation unit 109. Then, based on that comparison result, the determination unit 113 determines whether the inputted singing voice data is data indicating falsetto. In this manner, a series of processes from frequency analysis to determination can be performed with a small amount of computation for each predetermined frame, and thus accumulation or machine learning of singing voice data are not required. This allows a determination of falsetto to be made on a real-time basis without requiring an enormous amount of data.

(Second Embodiment)

A sound quality determination function 100*a* in a second embodiment of the present invention is different from the sound quality determination function 100 in the first embodiment in that it uses an overtone ratio in addition to the tilt described in the first embodiment as sound quality parameters to make a falsetto determination based on the tilt and the overtone ratio. Here, the overtone ratio is a parameter indicating a frequency ratio of overtone with respect to the frequency of the fundamental tone. Note in the present embodiment that description is made by focusing attention on differences in structure from the sound quality determination function 100 in the first embodiment and an identical portion is provided with the same reference numeral and its description is omitted.

Figure 5:
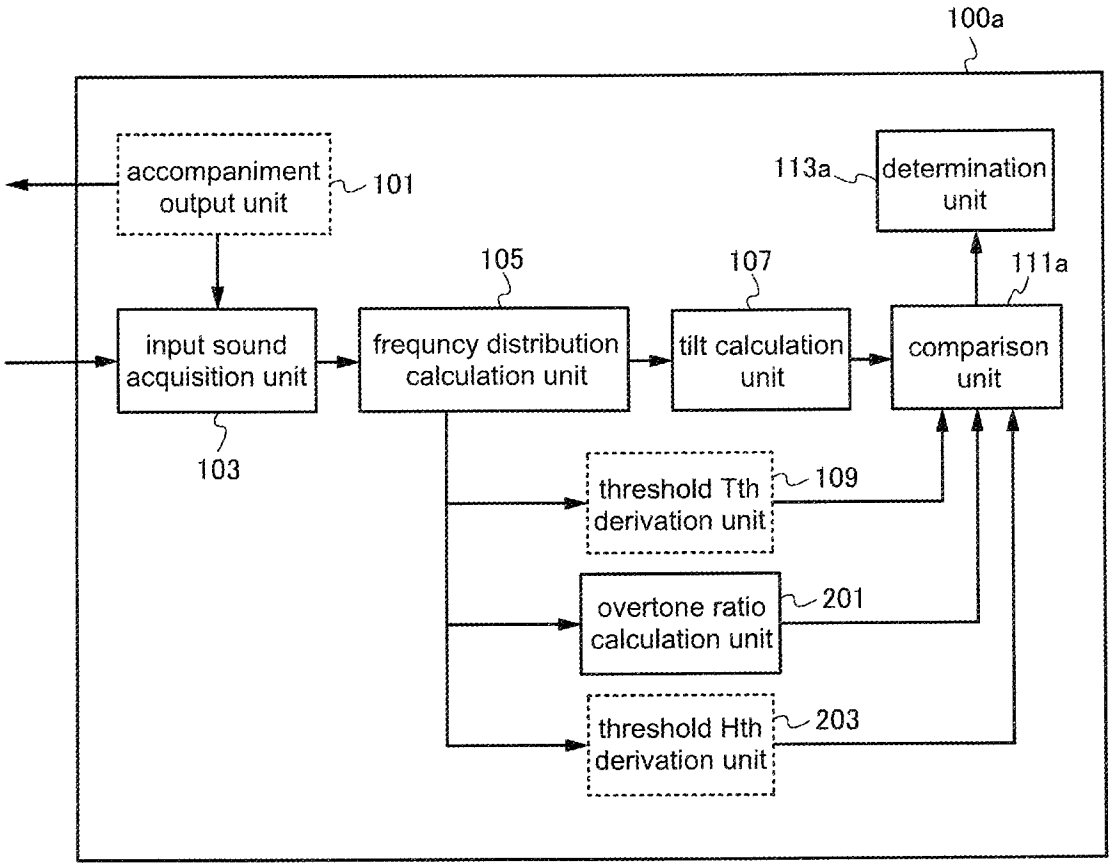
FIG. 5 is a block diagram depicting the structure of a sound quality determination function in a second embodiment of the present invention.

FIG. 5 is a block diagram depicting the structure of the sound quality determination function 100*a* in the second embodiment of the present invention. The sound quality determination function 100*a* includes the accompaniment output unit 101, the input sound acquisition unit 103, the frequency distribution calculation unit 105, the tilt calculation unit 107, the threshold Tth derivation unit 109, an overtone ratio calculation unit 201, a threshold Hth derivation unit 203, a comparison unit 111*a*, and a determination unit 113*a*.

The overtone ratio calculation unit 201 calculates an overtone ratio by using the intensity of the frequency of the fundamental tone acquired from the frequency distribution calculation unit 105 and the intensity of the frequency of the overtone. Here, an example of a specific overtone ratio calculation method is described by using FIG. 6.

Figure 6:
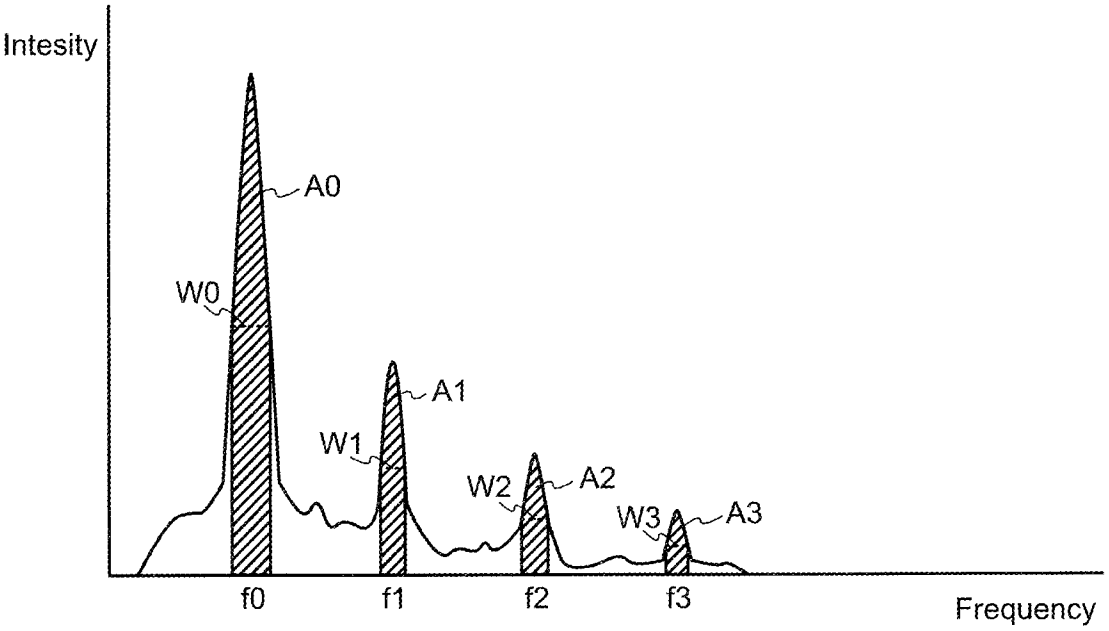
FIG. 6 is a diagram for describing an overtone ratio calculation method.

FIG. 6 is a diagram depicting a frequency distribution in singing voice data for one frame. In this example, intensity peaks appear at the frequency f0 of the fundamental tone and the frequencies f1 to f3 of overtones. The overtone ratio is a ratio of frequencies of overtone with respect to the frequency of the fundamental tone and can be thus represent as "intensity of frequency of overtone/intensity of frequency of fundamental tone". In the present embodiment, areas A0 to A3 occupied by the respective peaks are found with reference to the widths of intensity (for example, half widths W0 to W3) in the respective overtones, and these areas A0 to A3 are computed as intensities at the respective peaks. Therefore, an overtone ratio in the frequency distribution depicted in FIG. 6 can be found by "(A1+A2+A3)/A0".

Note that the overtone ratio calculation method is not limited to the above-described example. For example, the area of each peak may be found with reference to a predetermined width other than the half widths, or a maximum peak value of each peak may be used as an intensity in a simple manner. Also, any overtone for use in overtone ratio calculation can be determined in a manner such that, for example, harmonics up to the third harmonic or the fourth harmonic are used or only a harmonic included in a specific frequency band is used. Furthermore, for example, the overtone ratio can be calculated by using an overtone with a certain intensity or more.

The threshold Hth derivation unit 203 derives an overtone-ratio-related threshold (Hth). As with the tilt-related threshold (Tth), the overtone-ratio-related threshold (Hth) is a value which changes depending on the pitch. That is, the overtone-ratio-related threshold (Hth) can be derived also by using a predetermined arithmetic expression (for example, a function Ff(f0) with pitch taken as an independent variable). Here, the predetermined arithmetic expression may be a linear function or a higher-order function of a second order or higher. Furthermore, in place of the scheme of using a predetermined arithmetic expression, the threshold may be derived from a lookup table with pitches and thresholds associated with each other in advance. It is only required that these arithmetic expression and lookup table are found in advance by, for example, performing statistical processing on various singing voices.

The comparison unit 111*a* compares the tilt acquired at the tilt calculation unit 107 and the threshold (Tth) acquired at the threshold Tth derivation unit 109 and also compares the overtone ratio acquired at the overtone ratio calculation unit 201 and the threshold (Hth) acquired at the threshold Hth derivation unit 203, and then outputs a signal indicating a relation in magnitude between the tilt and the threshold (Tth) and a signal indicating a relation in magnitude between the overtone ratio and the threshold (Hth) to the determination unit 113*a*.

The determination unit 113*a* determines based on the signal indicating the relation in magnitude between the tilt and the threshold (Tth) acquired from the comparison unit 111*a* and the signal indicating the relation in magnitude between the overtone ratio and the threshold (Hth) whether the singing voice data acquired at the input sound acquisition unit 103 indicates falsetto. Specifically, when a tilt in a certain frame is equal to or larger than the threshold (Tth) and the overtone ratio is equal to or smaller than the threshold (Hth), the singing voice in that frame is determined as falsetto. Note that while the example has been described in which whether the singing voice is falsetto is determined per frame unit herein, a configuration may be adopted in which the singing voice is determined as falsetto when the above-described condition is satisfied successively for a predetermined number of frame or more.

Figure 7A:
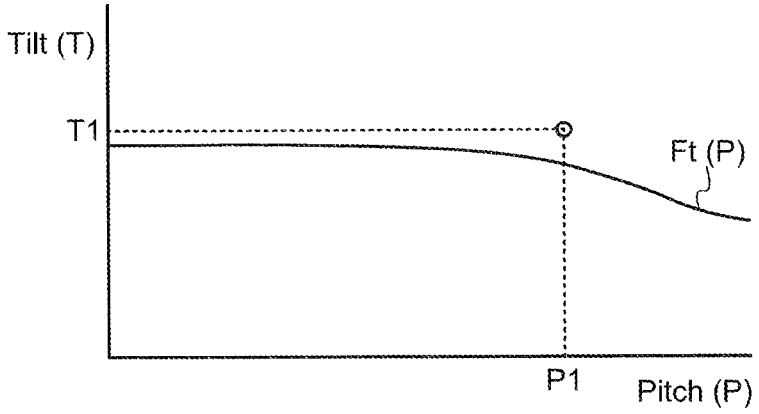
FIG. 7A is a diagram for describing a concept of falsetto determination by a determination unit configuring a sound quality determination function in the second embodiment of the present invention.
Figure 7B:
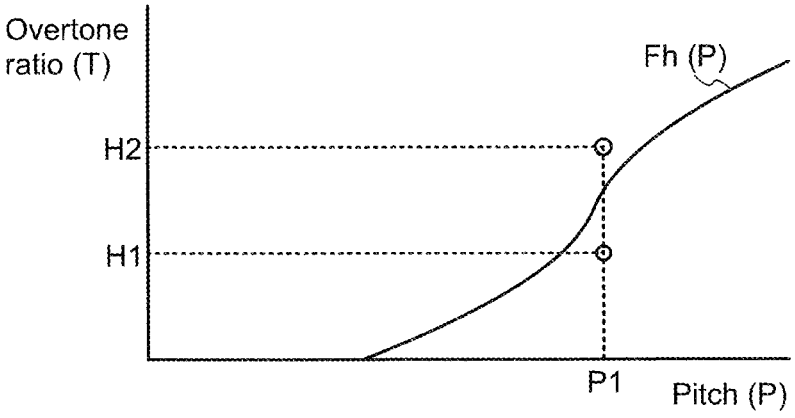
FIG. 7B is a diagram for describing a concept of falsetto determination by the determination unit configuring the sound quality determination function in the second embodiment of the present invention.

FIG. 7A and FIG. 7B are diagrams for describing a concept of falsetto determination in the determination unit 113*a*. In the determination unit 113*a* of the present embodiment, a determination as to whether the singing voice is falsetto is made by using both of a determination based on the tilt depicted in FIG. 7A and a determination based on the overtone ratio depicted in FIG. 7B. In FIG. 7A, the horizontal axis represents pitch (P) and the vertical axis represents tilt (T). As with FIG. 4, a function Ft(P) corresponds to an arithmetic expression for deriving a tilt-related threshold (Tth). Also, in FIG. 7B, the horizontal axis represents pitch (P) and the vertical axis represents overtone ratio (H). A function Fh(P) corresponds to an arithmetic expression for deriving an overtone-ratio-related threshold (Hth).

As depicted in FIG. 7A, in a certain frame 1, it is assumed that the pitch is P1, the tilt is T1, and T1 is equal to or larger than the threshold (Ft(P1)). In this case, while the determination unit 113 in the first embodiment determines that the singing voice in the frame 1 is falsetto, a determination based on the overtone ratio with the same pitch (P1) is further added in the determination unit 113*a* in the present embodiment. For example, as depicted in FIG. 7B, when the pitch is P1 and the overtone ratio is H1, that is, the overtone ratio is equal to or smaller than the threshold (Fh(P1)), the inputted singing voice is determined as falsetto. Conversely, when the pitch is P1 and the overtone ratio is H2, that is, the overtone ratio exceeds the threshold (Fh(P1)), the inputted singing voice is determined as a natural voice even if the tilt (T1) is equal to or larger than the threshold (Ft(P1)).

That is, in the present embodiment, in a three-dimensional coordinate system with the pitch, the tilt, and the overtone ratio each taken as an axis, a singing voice positioned in a certain space where the tilt is equal to or larger than the threshold (Ft(P)) and the overtone ratio is equal to or smaller than the threshold (Fh(P)) with a predetermined pitch is determined as falsetto. Note that while the above-described function Ft(P) and the function Fh(P) can both change depending on the vocalist, the function Ft(P) and the function Fh(P) can be found by statistically processing singing voices of various persons.

Figure 8:
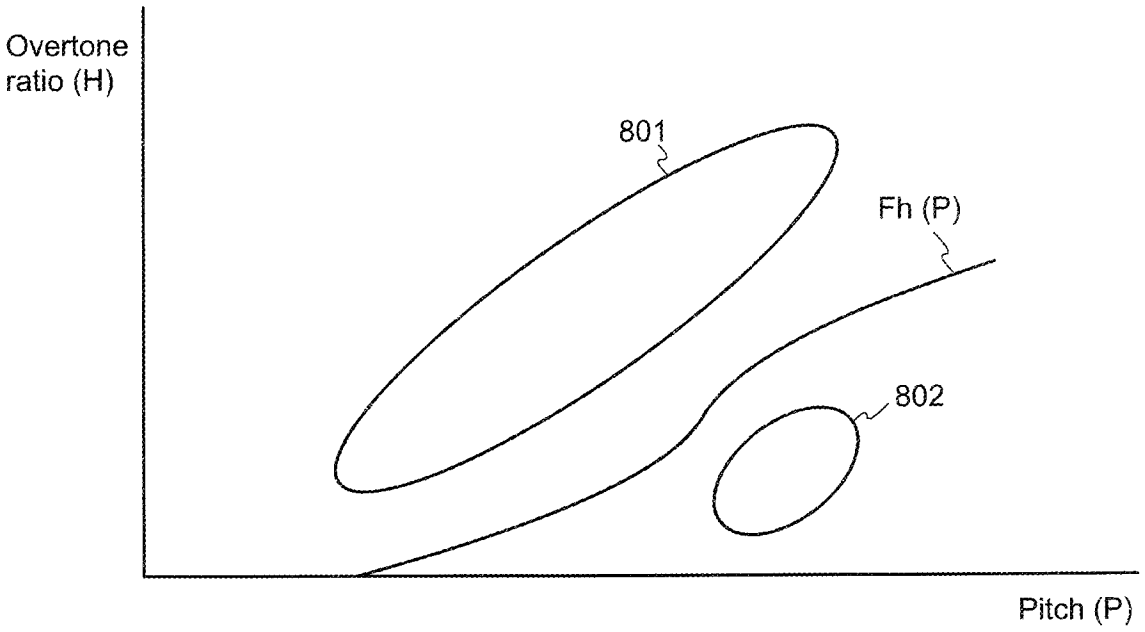
FIG. 8 is a diagram for describing a correlation between pitches and overtone ratios.

According to the findings by the inventors, there is a tendency for the overtone ratio with respect to the fundamental tone decreases as the sound quality (voice quality) of the singing voice becomes closer to falsetto. Specifically, as depicted in FIG. 8, when statistics of singing voices are gathered by taking pitch on the horizontal axis and overtone ratio on the vertical axis, it has been found that, relatively, natural voices 801 tend to be distributed in a region with lower pitches and higher overtone ratios and falsetto 802 tend to be distributed in a region with higher pitches and lower overtone ratios. Thus, by delimiting a boundary between these natural voices 801 and the falsetto 802 simply by using the function Fh(P), a region equal to or smaller than the function Fh(P) in FIG. 8 can be estimated as a falsetto region.

As described above, the sound quality determination function 100*a* in the second embodiment calculates an overtone ratio in addition to the tilt described in the first embodiment as sound quality parameters, and compares these tilt and overtone ratio and each related predetermined threshold. Then, based on the comparison result of these, it is determined whether the inputted singing voice data is data indicating falsetto. In this manner, by using the overtone ratio as a sound quality parameter for falsetto determination in addition to the tilt, accuracy of falsetto determination is further improved, in addition to the effect described in the first embodiment.

(Third Embodiment)

While the example has been described in the sound quality determination function 100*a* in the second embodiment in which both of the tilt and the overtone ratio are used as sound quality parameters, it is also possible to determine whether the voice is falsetto in a simple manner from a relation between the overtone ratio and the pitch, as described by using FIG. 8.

A sound quality determination function 100*b* in a third embodiment of the present invention makes a falsetto determination based on the overtone ratio described in the second embodiment as a sound quality parameter. Note in the present embodiment that description is made by focusing attention on differences in structure from the sound quality determination functions 100 and 100*a* in the first embodiment and the second embodiment and an identical portion is provided with the same reference numeral and its description is omitted.

Figure 9:
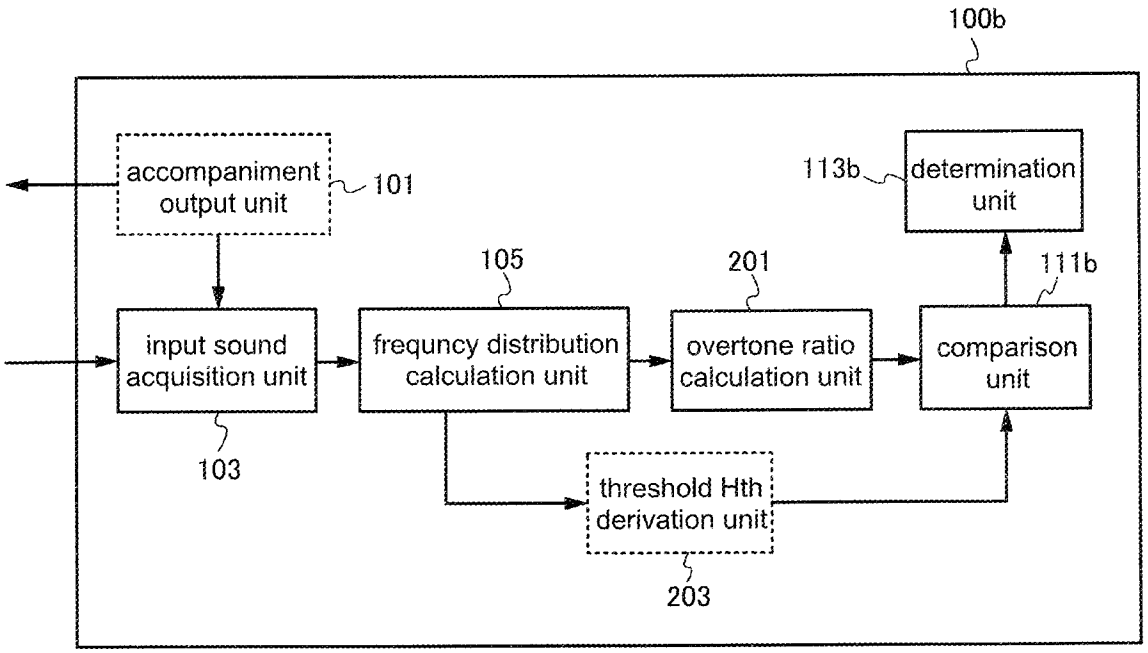
FIG. 9 is a block diagram depicting the structure of a sound quality determination function in a third embodiment of the present invention.

FIG. 9 is a block diagram depicting the structure of the sound quality determination function 100*b* in the third embodiment of the present invention. The sound quality determination function 100*b* includes the accompaniment output unit 101, the input sound acquisition unit 103, the frequency distribution calculation unit 105, the overtone ratio calculation unit 201, the threshold Hth derivation unit 203, a comparison unit 111*b*, and a determination unit 113*b*.

As described in the second embodiment, the overtone ratio calculation unit 201 calculates an overtone ratio by using the intensity of the frequency of the fundamental tone acquired from the frequency distribution calculation unit 105 and the intensity of the frequency of the overtone. Also, the threshold Hth derivation unit 203 derives an overtone-ratio-related threshold (Hth).

The comparison unit 111*b* compares the overtone ratio acquired at the overtone ratio calculation unit 201 and the threshold (Hth) acquired at the threshold Hth derivation unit 203, and outputs a signal indicating a relation in magnitude between the overtone ratio and the threshold (Hth) to the determination unit 113*b*.

The determination unit 113*b* determines based on the signal indicating the relation in magnitude between the overtone ratio acquired from the comparison unit 111*b* and the threshold (Hth) whether the signing voice data acquired at the input sound acquisition unit 103 indicates falsetto. Specifically, when an overtone ratio in a certain frame is equal to or smaller than the threshold (Hth), the singing voice in that frame is determined as falsetto.

Figure 10:
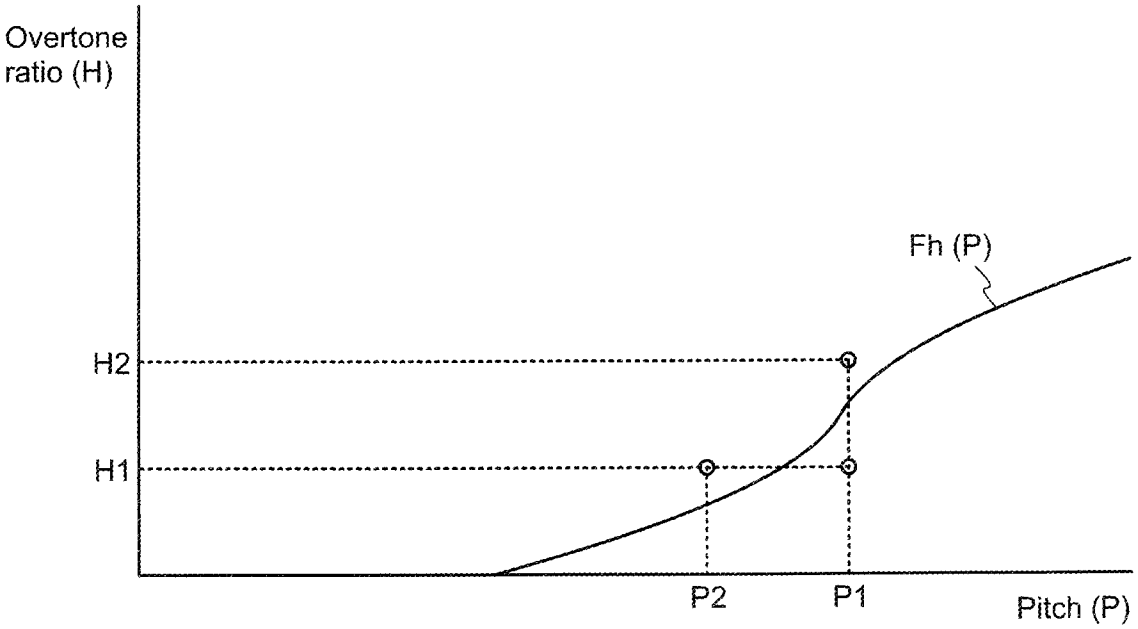
FIG. 10 is a diagram for describing a concept of falsetto determination by a determination unit configuring a sound quality determination function in the third embodiment of the present invention.

FIG. 10 is a diagram for describing a concept of falsetto determination in the determination unit 113*b*. In FIG. 10, the horizontal axis represents pitch (P) and the vertical axis represents overtone ratio (H). In FIG. 10, a function Fh(P) is depicted as a predetermined arithmetic expression for deriving the threshold (Hth) described in the second embodiment. In this example, when a pitch (P) in a certain frame is determined, the threshold (Hth) corresponding to that pitch is found from the function Fh(P). At the determination unit 113*b*, based on the result of comparison between the overtone ratio calculated at the overtone ratio calculation unit 201 and the threshold (Hth) found at the threshold Hth derivation unit 203 from the function Fh(P), it is determined that the singing voice in that frame is falsetto when the overtone ratio is equal to or smaller than the threshold (Tth).

In FIG. 10, in a certain frame 1, it is assumed that the pitch is P1, the overtone ratio is H1, and H1 is smaller than the threshold (Fh(P1)). In this case, the determination unit 113*b* determines that the singing voice in the frame 1 is falsetto. On the other hand, when the overtone ratio is H2 equal to or larger than the threshold even with the same pitch P1, the singing voice in the frame 1 is determined as a natural voice. Furthermore, when the overtone ratio exceeds the threshold (Fh(P2)) because the pitch becomes P2 lower than P1 even with the overtone ratio being H1, the singing voice is determined as a natural voice. Note that while the example has been described in which whether the singing voice is falsetto is determined per frame unit herein, a configuration may be adopted in which the singing voice is determined as falsetto when the above-described condition is satisfied successively for a predetermined number of frame or more.

As described above, the sound quality determination device 100*b* in the third embodiment calculates an overtone ratio as a sound quality parameter and compares the overtone ratio and its related predetermined threshold. Then, based on the comparison result, it is determined whether the inputted singing voice data is data indicating falsetto. In this manner, according to the sound quality determination function 100*b* in the present embodiment, a series of processes from frequency analysis to determination can be performed with a small amount of computation for each predetermined frame. Thus, accumulation or machine learning of singing voice data are not required, and a determination of falsetto can be made on a real-time while reducing the amount of computation.

MODIFICATION EXAMPLES

Each of the above embodiments can be modified as appropriate and as required. One example of modification examples is described below. These modification examples may be implemented in combination.

First Modification Example

In the sound quality determination function 100 in the first embodiment, the example has been described in which the threshold Tth derivation unit 109 derives the tilt-related threshold (Tth) based on the data acquired from the frequency distribution calculation unit 105 for comparison between the threshold and the tilt. However, the tendency of the tilt becoming steep when the voice is falsetto may not largely depend on the person. Thus, in a simple manner, it is possible to make a falsetto determination by assuming the threshold as a constant value.

Figure 11:
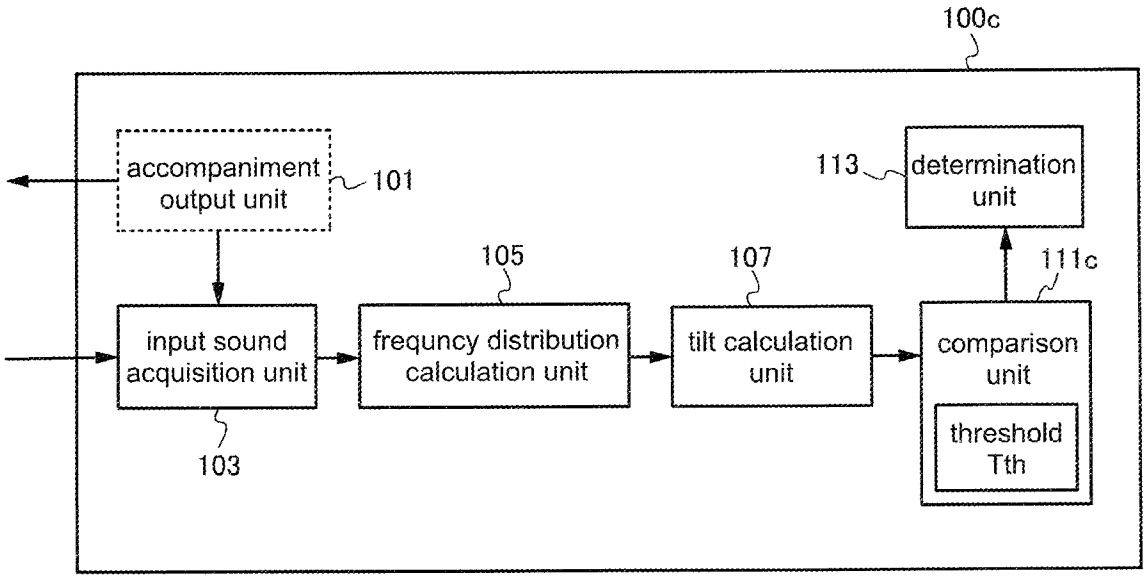
FIG. 11 is a block diagram depicting the structure of a sound quality determination function in a first modification example.

FIG. 11 is a block diagram depicting the structure of a sound quality determination function 100*c* in a first modification example. In the sound quality determination function 100*c*, the threshold Tth derivation unit 109 of the sound quality determination function 100 in the first embodiment is omitted, and a comparison unit 111*c* has the threshold Tth as a fixed value. Therefore, in the sound quality determination function 100*c*, when the tilt acquired at the tilt calculation unit 107 is inputted to the comparison unit 111*c*, a relation in magnitude is compared with the threshold Tth as a fixed value. Here, it is only required that the threshold Tth is found in advance by performing statistical processing on various singing voices.

This allows omission of threshold (Tth) derivation process, reduction of the load of the entire process of falsetto determination, and quicker falsetto determination.

Note that the example has been described herein in which the sound quality determination function 100 in the first embodiment is taken as an example, the tilt-related threshold (Tth) is taken as a fixed value, and the threshold Tth derivation unit is omitted. However, this is not meant to be restrictive and, with the overtone-ratio-related threshold (Hth) in the sound quality determination function 100*a* in the second embodiment and the sound quality determination function 100*b* in the third embodiment being taken as a fixed value, the threshold Hth derivation unit 203 can be omitted. Also, in this case, it is only required that the threshold Hth is provided to the comparison units 111*a* and 111*b*.

Furthermore, in the sound quality determination function 100*b* of the second embodiment, both of the threshold Tth derivation unit 109 and the threshold Hth derivation unit 203 can be omitted. In this case, it is only required that the threshold Tth and the threshold Hth are provided to the comparison unit 111*a*.

Second Modification Example

In each of the above-described embodiments, the example has been described in which the tilt-related threshold (Tth) or the overtone-ratio-related threshold (Hth) are found in advance. Any parameter of the arithmetic expressions (including the functions) for deriving these thresholds may be changeable as appropriate. For example, a parameter (for example, coefficient) is changed in accordance with the gender such as whether the singer is a male or female or the age such as whether the singer is an adult or child to allow a change of an arithmetic expression for deriving a threshold. This change of the setting parameter of the arithmetic expression may be performed automatically or manually. When this change is performed manually, for example, it is only required that the parameter of the arithmetic expression is changed by operating the operating unit 15 in the sound quality determination function depicted in FIG. 1.

Figure 12:
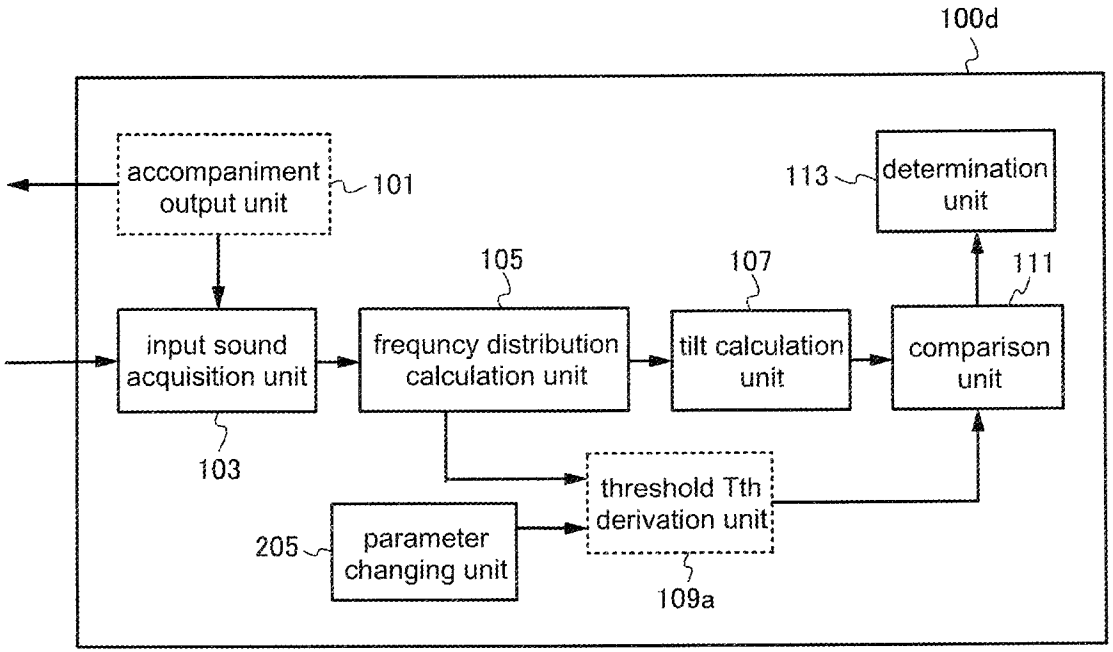
FIG. 12 is a block diagram depicting the structure of a sound quality determination function in a second modification example.

FIG. 12 is a block diagram depicting the structure of a sound quality determination function 100*d* in a second modification example. In the sound quality determination function 100*d*, the setting parameter of the function Ft(f0) can be changed at the threshold Tth derivation unit 109 in the sound quality determination function 100 in the first embodiment. As depicted in FIG. 12, data from a parameter changing unit 205 is inputted to the threshold Tth derivation unit 109*a* of the sound quality determination function 100*d*.

The parameter changing unit 205 outputs data for changing a constant (setting parameter) in the arithmetic expression for deriving the threshold Tth to the threshold Tth derivation unit 109*a*. For example, the parameter changing unit 205 outputs different data depending on whether the singer is a male or female to change the coefficient of the arithmetic expression described above, thereby allowing a change of the arithmetic expression for use in the threshold Tth derivation unit 109*a* to an arithmetic expression for males or an arithmetic expression for females.

By providing the parameter changing unit 205 as described above, a difference in sound quality between male falsetto and female falsetto can be reflected in falsetto determination by the determination unit 113, thereby allowing falsetto determination with higher accuracy. Note that while a modification of the first embodiment has been described as an example herein, it goes without saying that this can be applied to the sound quality determination function of the second embodiment or the third embodiment.

Third Modification Example

The parameter changing unit described in the second modification example can also be configured so as to change the parameter based on 22 information associated with an accompaniment sound. For example, the parameter changing unit can change the parameter based on information associated with an accompaniment sound and indicating a male part or a female part, information indicating an accompaniment sound for children, and so forth.

Figure 13:
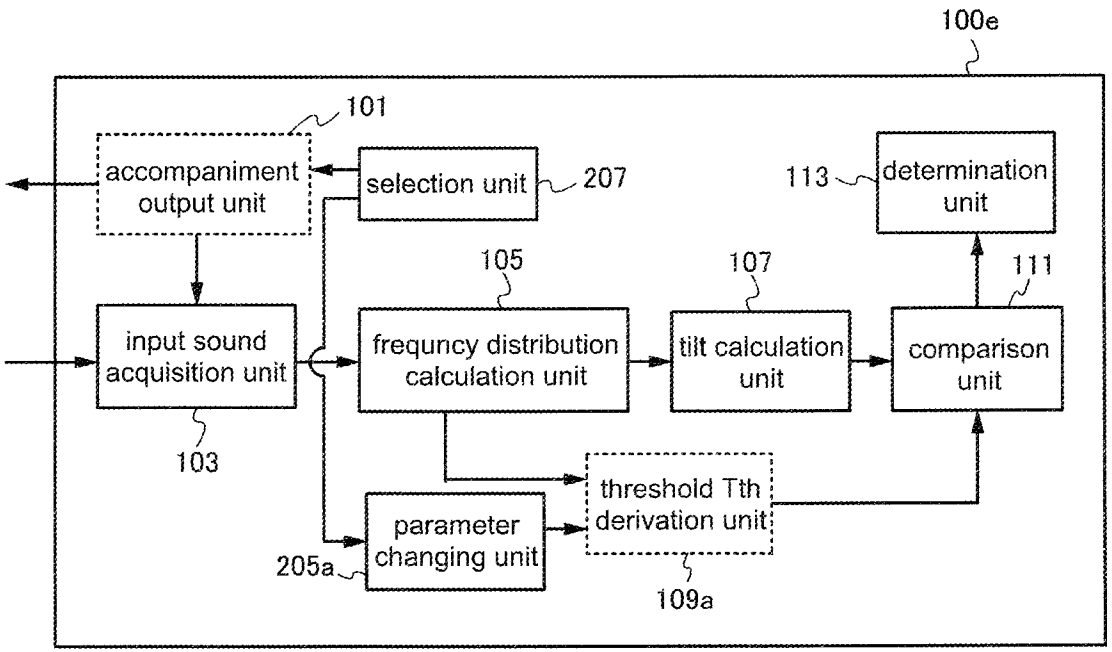
FIG. 13 is a block diagram depicting the structure of a sound quality determination function in a third modification example.

FIG. 13 is a block diagram depicting the structure of a sound quality determination function 100*e* in a third modification example. In the sound quality determination function 100*e*, a selection unit 207 which selects an accompaniment sound is connected to a parameter changing unit 205*a*. When the singer specifies a desired song, accompaniment data corresponding to the song is selected by the selection unit 207. A signal for making an instruction for selecting the accompaniment data by the selection unit 207 is inputted to the accompaniment output unit 101 for replay of the accompaniment data. Also, from the selection unit 207, information associated with the accompaniment sound is inputted to the parameter changing unit 205*a*.

The information associated with the accompaniment sound may be data accompanying the accompaniment data or another data stored in association with the accompaniment data. For example, when information indicating a male part is inputted to the parameter changing unit 205*a* as the information associated with the accompaniment sound, data corresponding to an arithmetic expression for male singers is outputted from the parameter changing unit 205*a* so as to change the arithmetic expression of the threshold Tth derivation unit 109*a* to the arithmetic expression for male singers.

Similarly, when information indicating a female part is outputted from the selection unit 207, data for setting the arithmetic expression to an arithmetic expression for female singers is outputted from the parameter changing unit 205*a*. When information indicating an accompaniment sound for children is outputted, data for setting the arithmetic expression to an arithmetic expression for children is outputted from the parameter changing unit 205*a*. Other than these, if information about frequent use of falsetto in association with an accompaniment sound is prepared, a parameter of the arithmetic expression can be changed so as to increase accuracy of falsetto determination. For example, a parameter of the arithmetic expression may be changed so that falsetto determination is performed by using only the tilt as in the first embodiment and, when the information about frequent use of falsetto is inputted to the parameter changing unit 205*a*, falsetto determination is performed by using both of the tilt and the overtone ratio as in the second embodiment.

By providing the selection unit 207 and the parameter changing unit 205*a* described above, fine parameter settings in the arithmetic expression can be made in the threshold Tth derivation unit 109*a* in accordance with the accompaniment sound, and a falsetto determination can be made with higher accuracy. Note that while a modification of the first embodiment has been described as an example herein, it goes without saying that this can be applied to the sound quality determination function of the second embodiment or the third embodiment.

Fourth Modification Example

In each of the above-described embodiments, the example has been described in which a falsetto determination is made from the singing voice by the singer as the sound quality determination device. However, not only falsetto but also another sound quality can be determined by using the tilt and/or the overtone ratio. For example, when a singing voice has a small tilt and an overtone ratio appearing somewhat high, the singing voice is determined as having a light sound quality. By grasping a tendency of the tilt or overtone ratio depending on the sound quality, various sound qualities can be determined.

Fifth Modification Example

In each of the above-described embodiments, the example has been described in which the sound quality (voice quality) of the human singing voice is to be determined. It is also possible to determine the sound quality of a sound emitted from a musical instrument or a synthesized singing sound (a singing sound generated by synthesizing waveforms so as to achieve a specified sound pitch while combining sound fragments corresponding to characters configuring lyrics). As with human voice, even in a sound emission from a musical instrument, as the sound becomes higher-order harmonic, the intensity may steeply decrease and a tilt (gradient) indicating a change in intensity of overtone with respect to frequency may become steep in a frequency distribution diagram. In this case, the sound emission from that musical instrument can be determined as having a sound quality equivalent to falsetto. The sound with this sound quality is basically close to a sine wave.

Those acquired by a person skilled in the art adding, deleting, or design-changing a component as appropriate or adding, omitting, or condition-changing a process based on the structure described as an embodiment of the present invention are also included in the range of the present invention if they have the gist of the present invention.

Also, even other operations and effects different from the operation and effect brought by the aspects of the embodiments described above are naturally construed as being brought by the present invention if they are evident from the description of the specification or can be easily predicted by a person skilled in the art.

What is claimed is:

1. A sound quality determination device comprising:

an interface configured to input a tone; and at least one processor or circuit configured to implement instructions stored in a memory and execute a plurality of tasks, including:

an acquisition task that acquires the input tone;

a frequency distribution calculation task that calculates a frequency distribution of each of a plurality of frames, each frame comprising a segment of a predetermined period of the input tone acquired by the acquisition task;

a tilt calculation task that calculates a tilt indicating a change in intensity of overtones of a fundamental frequency for each of the plurality of frames based on the respective frequency distribution calculated by the frequency distribution calculation task;

a tilt comparison task that compares each of the tilts of the plurality of frames calculated by the tilt calculation task and a tilt threshold; and a determination task that determines, based on a result of comparison by the tilt comparison task, whether the input tone contains a voice with a predetermined sound quality.

2. The sound quality determination device according to claim 1, the plurality of tasks include:

an overtone ratio calculation task that calculates an overtone ratio indicating a ratio of frequencies of the overtones, with respect to the fundamental frequency of each frame, based on the frequency distribution calculated by the frequency distribution calculation task; and an overtone ratio comparison task that compares the overtone ratio calculated by the overtone ratio calculation task and an overtone ratio threshold, wherein the determination task determines whether the input tone contains a voice with the predetermined sound quality based on the result of comparison by the tilt comparison task and a result of comparison by the overtone ratio comparison task.

3. The sound quality determination device according to claim 1, wherein the tilt calculation task calculates a gradient of a linear function acquired by linear approximation using the calculated tilts of the plurality of frames.

4. The sound quality determination device according to claim 1, wherein a value derived using the fundamental frequency in the frequency distribution is used as the tilt threshold.

5. The sound quality determination device according to claim 2, wherein a value derived using the fundamental frequency in the frequency distribution is used as the overtone ratio threshold.

6. The sound quality determination device according to claim 1, wherein:

the tilt threshold is derived from a predetermined arithmetic expression, and the device further comprises a parameter changing task that changes a parameter of the arithmetic expression.

7. The sound quality determination device according to claim 6, wherein the plurality of tasks include:

a selection task that selects an accompaniment sound to be output during an input period of the input tone, and the parameter changing task changes the parameter based on information associated with the selected accompaniment sound.

8. A non-transitory computer-readable recording medium storing a program executable by a computer to execute a method comprising the steps of:

acquiring an input tone;

calculating a frequency distribution of each a plurality of frames, each frame comprising a segment of a predetermined period of the acquired input tone;

calculating a tilt indicating a change in intensity of overtones of a fundamental frequency for each of the plurality of frames based on the respective calculated frequency distribution;

comparing each of the calculated tilts of the plurality of frames and a tilt threshold; and determining, based on a result of comparison in the comparing step, whether the input tone contains a voice with a predetermined sound quality.

9. A method comprising:

an acquiring step of acquiring an input tone;

a frequency distribution calculating step of calculating a frequency distribution of each of a plurality of frame, each frame comprising a segment of a predetermined period of the acquired input tone;

a tilt calculating step of calculating a tilt indicating a change in intensity of overtones of a fundamental frequency for each of the plurality of frames based on the respective calculated frequency distribution;

a tilt comparing step of comparing each of the calculated tilts of the plurality of frames and a tilt threshold; and a sound quality determining step of determining, based on a result of comparison in the tilt comparing step, whether the input tone contains a voice with a predetermined sound quality.

10. The method according to claim 9, further comprising:

an overtone ratio calculating step of calculating an overtone ratio indicating a ratio of frequencies of the overtones, with respect to the fundamental frequency of each frame, based on the calculated frequency distribution; and an overtone ratio comparing step of comparing the calculated overtone ratio and an overtone ratio threshold, wherein the sound quality determining step determines whether the input tone contains a voice with the predetermined sound quality based on the result of comparison in the tilt comparing step and a result of comparison in the overtone ratio comparing step.

11. The method according to claim 9, wherein the tilt calculating step calculates a gradient of a linear function acquired by linear approximation using the calculated tilts of the plurality of frames.

12. The method according to claim 9, wherein a value derived using the fundamental frequency in the frequency distribution is used as the tilt threshold.

13. The method according to claim 10, wherein a value derived using a fundamental frequency in the frequency distribution is used as the overtone ratio threshold.

14. The method according to claim 9, wherein:

the tilt threshold is derived from a predetermined arithmetic expression, and the method further comprises a parameter changing step of changing a parameter of the arithmetic expression.

15. The method according to claim 14, further comprising:

a selecting step of selecting an accompaniment sound to be output during an input period of the input tone, wherein the parameter changing step changes the parameter based on information associated with the selected accompaniment sound.

16. The sound quality determination device according to claim 1, wherein the voice is a singing voice.

17. The sound quality determination device according to claim 16, wherein the determination task determines whether the input tone contains a falsetto voice.

18. The sound quality determination device according to claim 1, wherein the voice is a sound from a musical instrument or a synthesized singing voice.

19. The method according to claim 9, wherein the voice is a singing voice.

20. The method according to claim 9, wherein the voice is a sound from a musical instrument or a synthesized singing voice.

* * * * *